US006269677B1

(12) United States Patent
Torvinen et al.

(10) Patent No.: US 6,269,677 B1
(45) Date of Patent: Aug. 7, 2001

(54) PRESS BRAKE BACK GAUGE FINGER

(75) Inventors: Jukka M. Torvinen, Raleigh, NC (US); Stephen Turner, Royston, GA (US)

(73) Assignee: ABB T&D Technology Ltd., Zurich (CH)

( * ) Notice: Subject to any disclaimer, the term of this patent is extended or adjusted under 35 U.S.C. 154(b) by 0 days.

(21) Appl. No.: 09/473,408

(22) Filed: Dec. 28, 1999

(51) Int. Cl.[7] ..... B21D 11/22

(52) U.S. Cl. ..... 72/461; 72/420; 72/389.3; 72/16.2; 72/17.3

(58) Field of Search ..... 72/420, 422, 461, 72/389.3, 16.2, 17.3

(56) References Cited

U.S. PATENT DOCUMENTS

| | | | | |
|---|---|---|---|---|
| Re. 34,569 | | 3/1994 | Sartorio | 72/420 |
| 4,089,200 | * | 5/1978 | Wingate et al. | 72/389 |
| 4,357,821 | | 11/1982 | Fowler | 72/389 |
| 4,488,237 | | 12/1984 | Aronson et al. | 364/476 |
| 4,706,491 | | 11/1987 | Sartorio | 72/461 |
| 4,753,099 | | 6/1988 | Klingel | 72/389 |
| 4,827,757 | | 5/1989 | Sartorio | 72/420 |
| 5,117,670 | | 6/1992 | Sartorio | 72/384 |
| 5,182,936 | | 2/1993 | Sartorio | 72/420 |
| 5,187,958 | | 2/1993 | Prunotto et al. | 72/9 |
| 5,573,319 | | 11/1996 | Dirk | 312/100 |
| 5,586,465 | | 12/1996 | Alcini et al. | 72/441 |
| 5,761,940 | * | 6/1998 | Moore, Jr. et al. | 72/420 |
| 5,844,146 | | 12/1998 | Murray et al. | 73/862.043 |
| 5,865,056 | | 2/1999 | Nagakura | 72/461 |
| 5,950,485 | | 9/1999 | Sartorio | 72/422 |
| 5,987,958 | | 11/1999 | Moore, Jr. et al. | 72/422 |
| 5,988,855 | | 11/1999 | Marobin | 364/472.01 |

* cited by examiner

*Primary Examiner*—David Jones
(74) *Attorney, Agent, or Firm*—Woodcock Washburn Kurtz Mackiewicz & Norris

(57) ABSTRACT

Apparatus and method to facilitate the insertion, alignment, and bending of metal sheets in a press brake machine is described herein. Automated insertion of properly aligned sheets into a bending machine can be accomplished using a press brake that includes at least two press brake fingers that act independently with respect to one another to determine whether the sheet has been received by the respective finger. The fingers are electrically coupled (via the sheet itself, for example) to a processor that communicates with. a robot. As the robot inserts the metal sheet into the press brake, it adjusts the alignment of the sheet until the sheet contacts the back planes of both press brake fingers. An electrical connection is formed when the metal sheet is received by the fingers (which are maintained at a nominal potential of 24V). When electrical connections are formed with both fingers, the processor tells the robot that the sheet is aligned and bending of the sheet can begin. Thus, each finger acts as a sensing device to determine whether the sheet is completely inserted and properly aligned in the press brake.

9 Claims, 5 Drawing Sheets

PRESS BRAKE BACK GAUGE FINGER

FIELD OF THE INVENTION

This invention relates to press brakes. More particularly, the invention relates to apparatus and methods for aligning a sheet within the back gauge fingers of a press brake.

BACKGROUND OF THE INVENTION

The present invention relates to an automated method and apparatus for bending metal sheets for large electrical enclosures such as enclosures for electrical transformer tanks. In electrical power distribution systems, distribution transformers are used to step down voltage between the high voltage power line and the user. Transformers are typically mounted above ground on a junction pole, or at ground level on a pad or platform. The increased use of underground power distribution systems has resulted in a corresponding increase in the number of pad-mounted transformers. The transformer includes a tank, which contains the core and coil assembly immersed in oil, and a cabinet, which includes a top hinged door and a bolted in place sill. Connections for incorporating the transformer assembly into the power distribution system extend through one wall of the tank and are enclosed by the cabinet. In order to provide utility personnel the necessary access to the transformer connections, the cabinet must also include a door. The cabinet door is pivotally attached to the tank along the top edge of the front plate of the tank. The cabinet also includes a low sill extending forward from the transformer tank, upon which the cabinet door rests when closed.

Transformer enclosures are generally fabricated from two to four metal sheets. The sheet material for these tanks are generally less than 10-gauge carbon steel or 10-gauge stainless steel. However, other kinds and gauges of metals may be used depending upon customer requirements. It is important that the method of fabrication for these enclosures be flexible enough to accommodate the broad range of enclosures that are fabricated in the transformer assembly line. The geometry of these enclosures is typically a three-dimensional box, i.e., cube-shaped or rectangular parallelepiped-shaped, but can also be extended to other shapes such as cylinders. The dimensions of the sheets that comprise these enclosures vary depending upon customer requirements. For example, a rectangular parallelepiped-shaped transformer enclosure generally comprises a front panel, a tank wrapper, a door wrapper, and a door top. Typical metal sheet size ranges, from smallest sheet size to largest sheet size, are 39"×32" to 55"×36",58"×25" to 90"×32",64"×19" to 80"×27",32"×17" to 36"×23–, for the front panel, tank wrapper, door wrapper, and door top, respectively.

The metal sheets are bent at angles, usually 90±1° but may include other angle measurements, to form the electrical enclosures. The bending machine is used to bend right angle bends, hem bends, and special bends for the door sheets. Bending of metal sheets are typically accomplished in bending machines such as press brake machines. Press brakes are also sometimes referred to as bending brakes, bending presses or pan brakes. Typically, a press brake is a hydraulic, mechanical, or pneumatic press which has a metal die and a metal punch known as a press brake tool which are shaped to form a particular bend or curve in the sheet metal when the die and tool are pressed together with the sheet metal in-between.

The present method to bend the enclosure requires an operator to feed the individual metal sheets into the bending machine. The metal sheets that are loaded into the machine may weigh approximately 80 to 100 pounds and are large and cumbersome to handle. It is understood that other weights and sheet sizes may also be used. Because of these difficulties in handling, this method increases the likelihood of occupational injuries.

Automation of the bending process is difficult. Each enclosure assembled is customized based upon varying customer requirements. The transformer tank assembly line, unlike traditional assembly lines, builds a variety of custom-sized pad-mounted enclosures rather than one particular size. The operator must ensure that the sheet is the correct sheet for the particular assembly being built. Lastly, and more importantly, alignment of the sheet into the bending machine is critical. The operator must ensure that the metal sheet is aligned correctly into the bending machine to ensure that the bend is placed at the correct location on sheet. A slight offset in inserting the sheet may result in scrapping or re-working of the bent sheet. For example, a ¼° rotational offset in the insertion of a 10' long sheet results in an offset of approximately 0.5" from the correct bend line.

Automated bending of properly aligned sheets into a bending machine can be accomplished using a bending machine such as a press brake. The press brake machine comprises at least two press brake fingers that act independently with respect to one another to determine whether the sheet has been received by the respective finger. The fingers are electrically coupled (via the sheet itself, for example) to a processor that communicates with a robot. As the robot inserts the metal sheet into the press brake, it adjusts the alignment of the sheet until the sheet is received by both press brake fingers. An electrical connection is formed when the metal sheet is received by the fingers. When electrical connections are formed with both fingers, the processor tells the robot that the sheet is aligned and bending of the sheet can begin. Thus, each finger acts as a sensing device to determine whether the sheet is completely inserted and properly aligned in the press brake.

In the process of inserting the metal sheet into the bending machine, however, the metal sheet removes or shaves away the insulation layer on the support member. The insulation shavings interfere with or prevent the electrical connection that is formed between the metal sheet and the conductive back plane. In addition, if the insulation is completely shaved away, thereby exposing the conductive layer underneath the layer, there may be a possibility of false alignment readings.

SUMMARY OF THE INVENTION

The present invention relates to methods and apparatus for automatically aligning and bending metal sheets for large sheet metal enclosures, such as enclosures for electrical transformer tanks. Typically, a bending machine, such as a press brake, is used to bend metal sheets at certain angles to form electrical enclosures. The present invention utilizes a robotic operator, a bending machine such as a press brake, a plurality of press brake fingers and a computer processor to insert, align, and bend sheets to meet precise customer requirements.

Automated insertion of properly aligned sheets into a bending machine can be accomplished using a press brake that comprises at least two press brake fingers that act independently with respect to one another to determine whether the sheet has been received by the respective finger. The fingers are electrically coupled (via the sheet itself, for example) to a processor that communicates with a robot. As the robot inserts the metal sheet into the press brake, it adjusts the alignment of the sheet until the sheet is contacted by both press brake fingers. An electrical connection is formed when the metal sheet is contacted by the fingers (which are maintained, for example, at a nominal potential of 24V). When electrical connections are formed with both fingers, the processor tells the robot that the sheet is aligned and bending of the sheet can begin. Thus, each finger acts as a sensing device to determine whether the sheet is completely inserted and properly aligned in the press brake.

The apparatus of the present invention comprises an electrically conductive support member and back plane. The support member is covered with a layer of insulation to electrically isolate the metal sheet as it is translated across the support member. An insulator shield is disposed atop the layer of insulation to protect the insulation layer as the metal sheet is translated across the support member.

It is to be understood that both the foregoing general description and the following detailed description are exemplary and are intended to provide further explanation of the invention as claimed. The accompanying drawings are included to provide a further understanding of the invention. In the drawings, like reference characters denote similar elements throughout several views. It is to be understood that various elements of the drawings are not intended to be drawn to scale.

A more complete understanding of the present invention, as well as further features and advantages of the invention such as its application to other assemblies that comprise bent metal sheets, will be apparent from the following Detailed Description and the accompanying drawings.

DETAILED DESCRIPTION OF PREFERRED EMBODIMENTS

The present invention provides an automated method and apparatus for bending metal sheets that comprise an electrical enclosure. More particularly, the present invention discloses apparatus for precisely aligning a metal sheet prior to bending.

A commercially available robot, such as an ABB IRB 6400 robot, is used to handle the metal sheet and insert the sheet into the bending machine. The requirements of each sheet to be bent (i.e., bend location, bend angle, etc.) are down-loaded to the robot through a main computer interface. The robot will retrieve the metal sheet on an individual basis from its previous operation. The robot supports the metal sheet from underneath, or on one side or edge of the sheet, via vacuum grippers. These vacuum grippers can accommodate the varying weights, dimensions, and materials of each sheet that is bent. Other gripping means, that support the sheet and allow the robot to manipulate the sheet, can also be used without departing from the spirit of the present invention.

Figure 1:
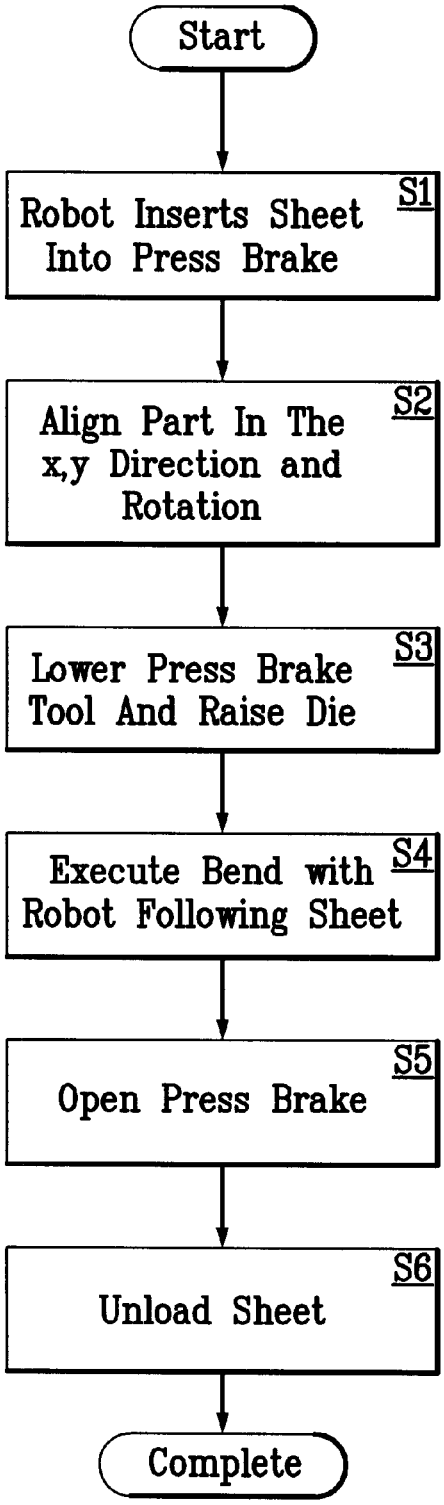
FIG. 1 provides a flow chart of the main steps in the bending process.
Figure 3:
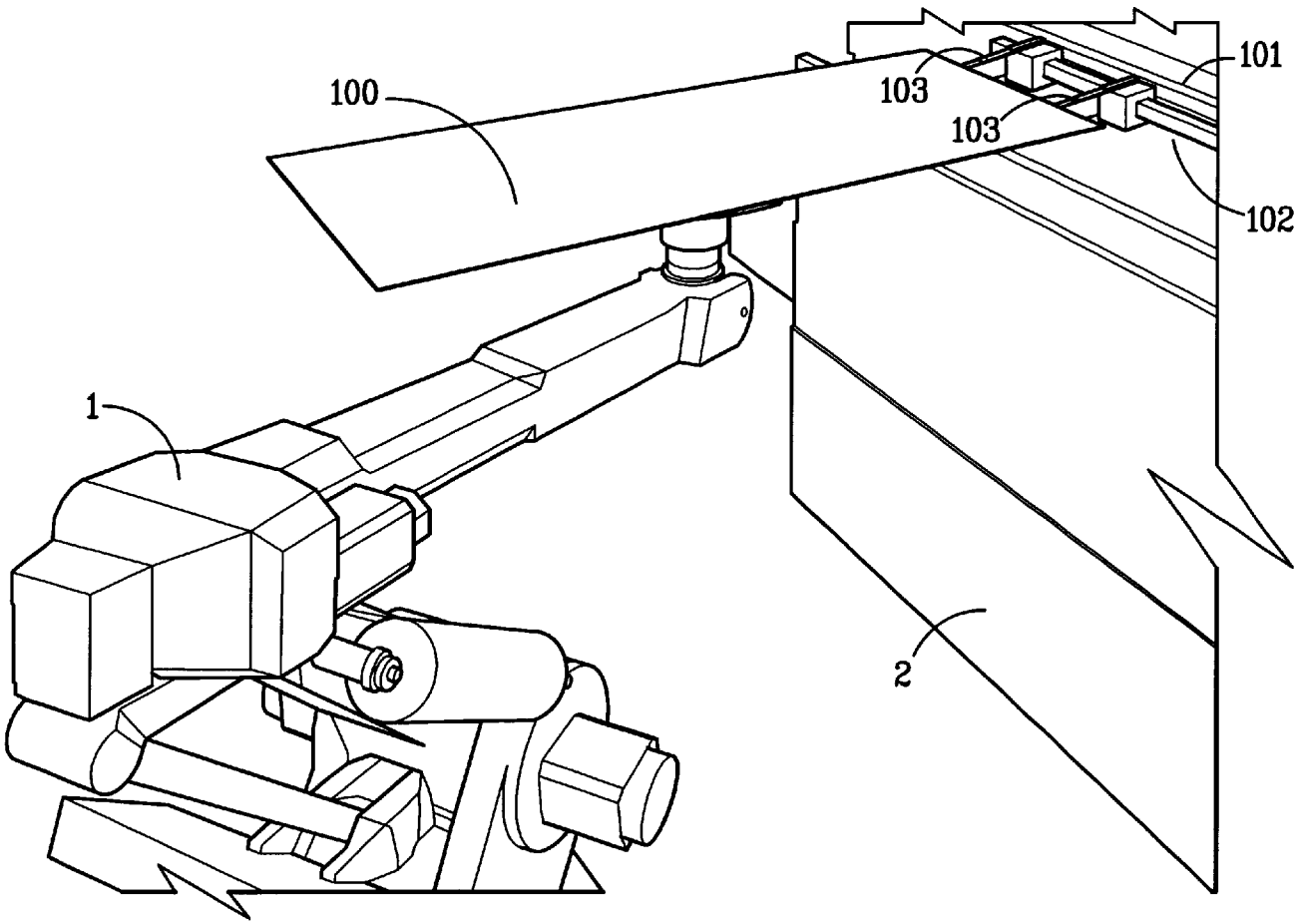
FIG. 3 provides an isometric view of a robot inserting a sheet into a bending machine.

FIG. 1 provides a process flow chart that provides the typical steps that comprise the automated bending process. In step S1 of FIG. 1, the robot operator inserts the sheet so that it is perpendicular or parallel to the press brake tool and die combination used to create the bend line. FIG. 3 provides an isometric view of robot 1 inserting sheet 100 into the press brake machine 2. In FIG. 3, robot 1 translates the sheet 100 across the machine die 102, underneath the press brake tool 101, and across the press brake fingers 103. The location of the bend line may be determined in relation to the edge of the metal sheet that is inserted into the bending machine. The robot continues to push the sheet across the press brake finger support until it reaches one or both of the conductive back planes of each press brake finger.

Figure 2:
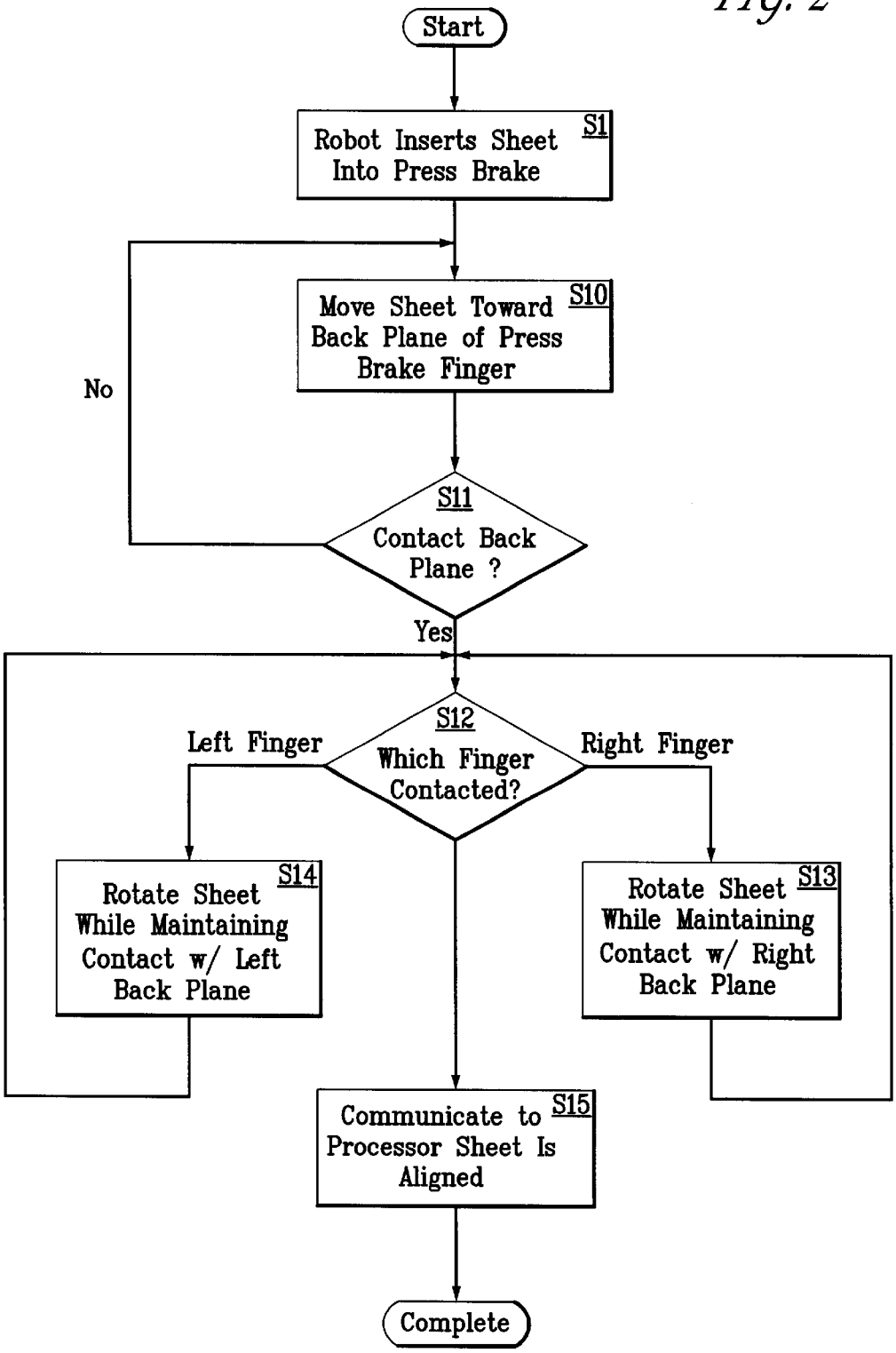
FIG. 2 provides a flow chart of the main steps in the aligning process.

Referring to step S2 in FIG. 1, the robot aligns sheet 100 in the press brake or bending machine in the x andy axis as well as along a rotational orientation. FIG. 2 provides an example flow of the steps that comprise the alignment process. In step S1, the robot inserts the conductive metal sheet into the press brake. The press brake is comprised of at least two press brake fingers. Each press brake finger is comprised of an insulated support member and a conductive back plane or contact plane. The conductive back plane comprises, inter alia, a sensing device, such as an electrical potential of 24 V, that along with the die and the metal sheet complete an electrical connection. The sensing devices operate independently of each other.

In step S10, the robot moves the sheet across the support member of the press brake finger toward the conductive back plane of the press brake finger until contact is achieved in step S11. In step S12, the processor electrically communicates to each back plane in order to verify that both right and left back planes are contacted. Steps S13 and S14 depict the sequence of steps that the processor and robot undergoes if either back plane finger is not contacted with the sheet. If the metal sheet does not touch both back planes, or hits one back plane but not the other, the processor sends an electrical signal to the robot to begin rotating the sheet in a clockwise or counter-clockwise direction. The robot rotates the sheet in the direction towards the untouched back plane while continuing to maintain contact with the back plane of either left or right finger until it completes the electrical connection with the untouched sensing device. The sheet is properly aligned when the edge of the sheet touches both sensing devices thereby completing the electrical connection with each sensing device (refer to step S15 of FIG. 2). Once the electrical connection with both sensing devices are completed, the sensing devices electrically communicates, via the processor or similar means, to the robot to hold the sheet still to begin bending.

Figure 4:
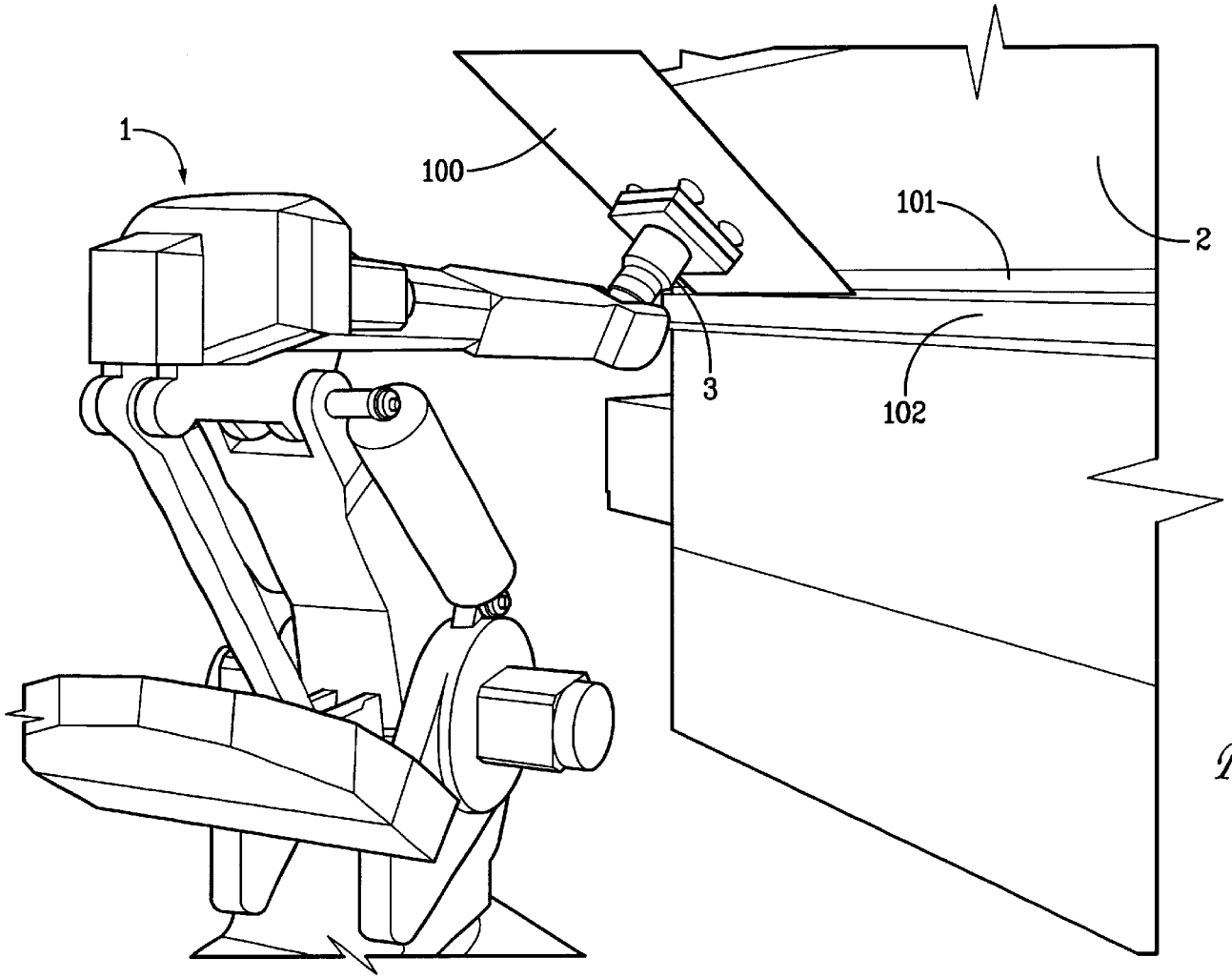
FIG. 4 provides an isometric view of a robot following the sheet during the execution of the bend.

Returning to FIG. 1, once the sheet is properly aligned, in step S3, robot 1 holds sheet 100 still while the press brake tool and die engage. The press brake tool 101 within the bending machine is translated downwardly until it touches the sheet 100 that is now sandwiched between the machine tool 101 and die 102. Next, the bend cycle, step S4, is executed by press brake machine 3 while robot 1 follows the bend while supporting sheet 100 from underneath with its vacuum gripper 3. FIG. 4 provides an isometric view of robot 1 following sheet 100 during the bend. The robot may be instructed to move forward toward the machine while still supporting the sheet from underneath thereby forming a bend within the sheet. The processor adjusts the speed and trajectory of the robot's movement based upon the location where the robot supports the sheet. Lastly, referring to steps S5 and S6 of FIG. 1, the press brake machine 2 is opened and sheet 100 is unloaded. After the bend is formed in the sheet, the press brake tool translates upwardly and the processor sends a signal to the robot that allows the robot to remove the sheet.

Figure 5:
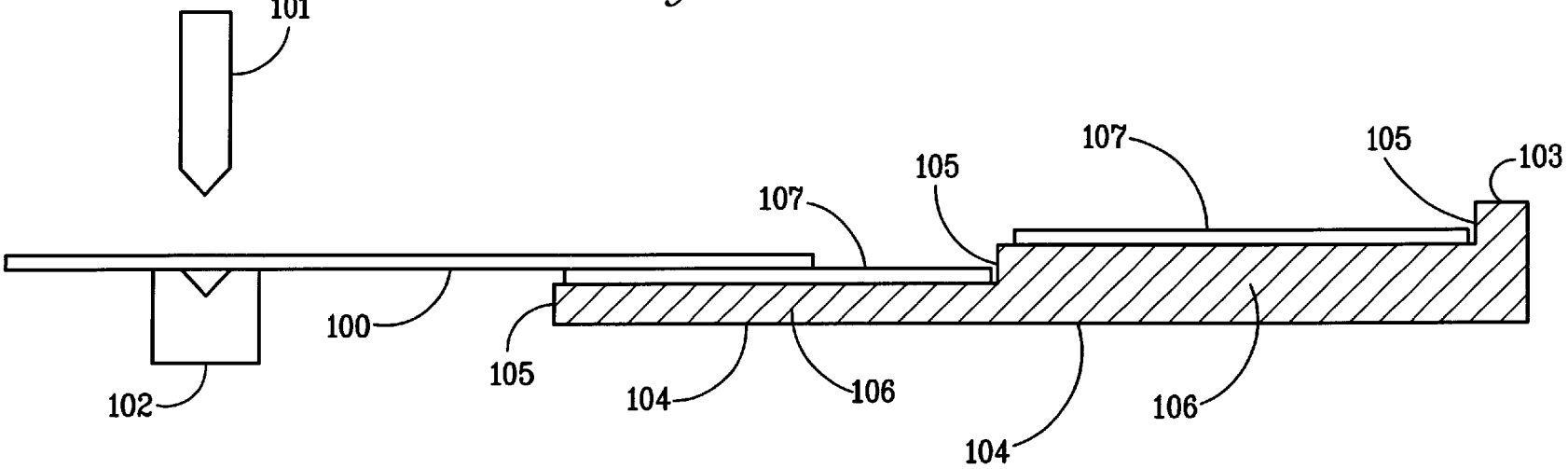
FIG. 5 provides a side view of an embodiment of the present invention.

FIG. 5 provides a side view of the preferred embodiment of the present invention. The bending machine is comprised of one or more press brake fingers 103 that are spaced apart from each other within the bending machine. The press brake finger 103 is made from a conductive material such as metal. Press brake finger 103 is further comprised of one or more support members 104 and back planes 105. Voltage is sent to the press brake fingers 103 to create an electrical potential. The robot inserts the metal sheet 100 across support member 104 to touch back plane 105. An electrical connection is formed when the sheet 100 touches the back plane 105. A processor activates the bend sequence when the metal sheet hits the back planes 105 of both press brake fingers 103.

To prevent false or premature alignment readings, the support member 104 is covered by an insulation layer 106. Insulation layer 106 could be any covering that electrically isolates the metal sheet from the conductive material comprising the support member. FIG. 5 shows press brake finger 103, with the exception of the back planes 105, wrapped with a commercially available insulation tape, such as electrical insulation tapes manufactured by 3M, that acts as insulation layer 106. It is understood that the present invention is not limited to that particular type or method of insulation. Insulation layer 106, however, must be capable of isolating the metal sheet from the electrical signal that is sent to the press brake fingers. Other methods of electrical insulation may include a insulative plastic layer disposed atop or affixed onto support member 104 instead of electrical insulation tape. A insulation shield 107, such as a metal strip, is placed atop insulation layer 106 on support member 104 to prevent the insulation layer underneath insulation strip 107 from being removed, worn, or damaged upon the insertion and translation of the metal sheet 100 across support member 104. Insulation shield 107 is selected to have sufficient hardness, flatness, and surface smoothness to allow sheet 100 to easily translate across its surface while protecting insulation layer 106.

Figure 6:
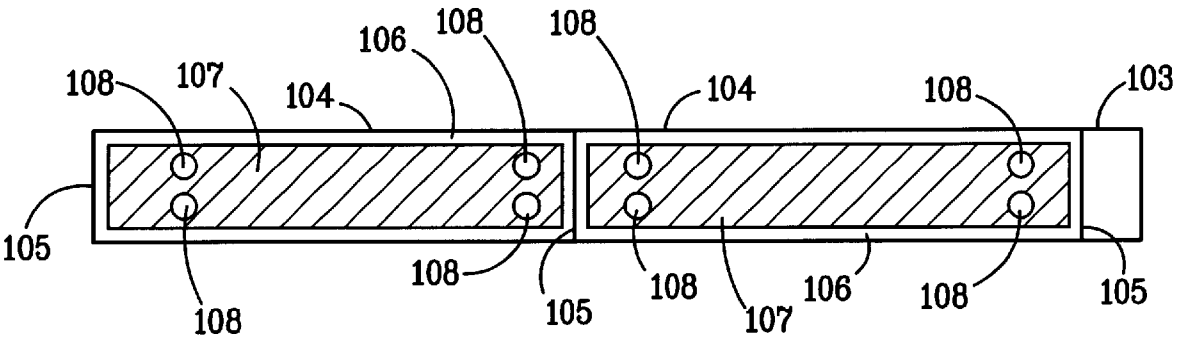
FIG. 6 provides a top view of the apparatus illustrated in FIG. 5.

FIG. 6 provides a top view of the preferred embodiment of the present invention. If a metal strip is selected as the insulation shield 107, the metal strip must be electrically isolated from the electrically conductive support member 104 and back plane 105. FIG. 6 depicts insulation shield 107 as a metal strip that is attached to insulation layer 106 through the use of insulated fasteners 108, such as recessed or sunk screws. In preferred embodiments, the gap between the edge of the metal strip 107 and the back plane 105 is more than the thickness of metal sheet 100 to allow further bends to sheet 100 that already have a short bend downwards (i.e., a 1" flange). In this case, sheet 100 is a L-shaped sheet and the tip of the L should be able to fit between strip 107 and the back gauge plane 105. The insulated fasteners 108 do not reach or connect the conductive metal comprising the body of the press brake finger 103. In preferred embodiments, the metal strip that acts as the insulation shield 107 is attached to the body of the finger 103 through plastic inserts. Thus, the metal strip 107 is electrically isolated from the conductive body and back planes 105 of the press brake finger 103.

Thus, apparatus according to the invention includes an electrically conductive support member having a conductive back plane, an insulator disposed on a first surface of the conductive support; and an insulator shield disposed on a second surface of said insulator opposite said conductive support member and conductive back plane, said insulator shield does not contact said electrically conductive support member or conductive back plane. The present invention is directed to parts and apparatuses used in the automated fabrication of large metal enclosures, that include, but are not limited to, electrical transformer tank enclosures, regardless of any specific description in the drawing or examples set forth herein. It will be understood that the present invention is not limited to use of any of the particular parts or assemblies discussed herein. Indeed, this invention can be used in any assembly line that requires automated feeding and alignment of bent metal sheets. Further, the apparatus disclosed in the present invention can be used with the method of the present invention or a variety of other applications.

While the present invention has been particularly shown and described with reference to the presently preferred embodiments thereof, it will be understood by those skilled in the art that the invention is not limited to the embodiments specifically disclosed herein. Those skilled in the art will appreciate that various changes and adaptations of the present invention may be made in the form and details of these embodiments without departing from the true spirit and scope of the invention as defined by the following claims.

What is claimed is:

1. An apparatus for aligning a sheet within a bending machine, said apparatus comprising:

an electrically conductive support member and conductive back plane;

an insulator having a first surface and a second surface, said first surface is attached to said conductive support member; and an insulator shield disposed on said second surface of said insulator opposite said conductive support member and conductive back plane, wherein said insulator shield is electrically isolated from said electrically conductive support member and said conductive back plane.

2. The apparatus of claim 1 wherein said insulator shield is fastened to said insulator.

3. The apparatus of claim 1 wherein said electrically conductive support member is substantially covered with insulator tape.

4. The apparatus of claim 1 wherein said insulator shield is comprised of metal.

5. The apparatus of claim 4 wherein said insulator shield is a dielectric.

6. A press brake finger, said finger comprising:

an L-shaped member comprised of an electrically insulated support and an electrically conductive back plane; and an insulator shield disposed on a first surface of said electrically insulated support, wherein said insulator shield does not contact said electrically conductive back plane.

7. The apparatus of claim 6 wherein said electrically insulated support is substantially horizontal.

8. The apparatus of claim 6 wherein said electrically conductive back plane is substantially vertical.

9. A method for bending a metal sheet, said method comprising the steps of:

a. inserting a metal sheet underneath a press brake tool and over two support fingers, said support fingers comprising a sensing device on a back plane that electrically communicates with a processor;

b. aligning said metal sheet by said processor electrically communicating to a robotic operator to manipulate said metal sheet until said metal sheet hits both of said sensing devices on said back plane thereby creating a signal that said sheet is aligned; and c. transmitting said signal from said processor to begin bending.

* * * * *